United States Patent [19]

Bay et al.

[11] 4,127,267

[45] Nov. 28, 1978

[54] COLLAPSIBLE FRAME WITH HANGING NET BALL ARRESTING APPARATUS

[76] Inventors: Marvon W. Bay, 706 James Blvd., Apt. 5, Worthington, Minn. 56187; Joel E. Di Marco, 4288 Revere Pl., Culver City, Calif. 90230

[21] Appl. No.: 798,793

[22] Filed: May 20, 1977

[51] Int. Cl.[2] ..... A63B 69/40

[52] U.S. Cl. ..... 273/26 A; 273/181 F; 273/102 S; 273/29 A

[58] Field of Search ..... 273/26 A, 29 A, 181 F, 273/55 B, 127 R, 102 S, 105 R, 176 B, 103; 248/346; D88/3 B; 135/4 R, 19, 5, 5 R, 7.1 R, 33 R

[56] References Cited

U.S. PATENT DOCUMENTS

| | | | |
|---|---|---|---|
| 1,566,945 | 12/1925 | Winkley | 273/181 F |
| 2,805,062 | 9/1957 | Holmes | 272/103 |
| 2,818,254 | 12/1957 | Dunn | 273/105 R |
| 2,839,300 | 6/1958 | Blaha et al. | 273/26 A |
| 3,195,898 | 7/1965 | Respini | 273/102 S |
| 3,394,932 | 7/1968 | Feflar | 272/103 |
| 3,752,476 | 8/1973 | Mahoney | 273/26 A |
| 3,856,301 | 12/1974 | Davidson | 273/181 F |

*Primary Examiner*—Richard C. Pinkham
*Assistant Examiner*—T. Brown
*Attorney, Agent, or Firm*—William H. Maxwell

[57] ABSTRACT

A portable frame for suspending a ball arresting net, wherein a collapsible base and standards comprised of telescoping members unfold from a collapsed condition to an adjustably open position where divergent base legs are extensible for support of the standards that are spaced thereby and extensible for elevating the net so as to be suspended under tension therebetween and to drop to the supporting ground plane.

23 Claims, 14 Drawing Figures

FIG. 3.
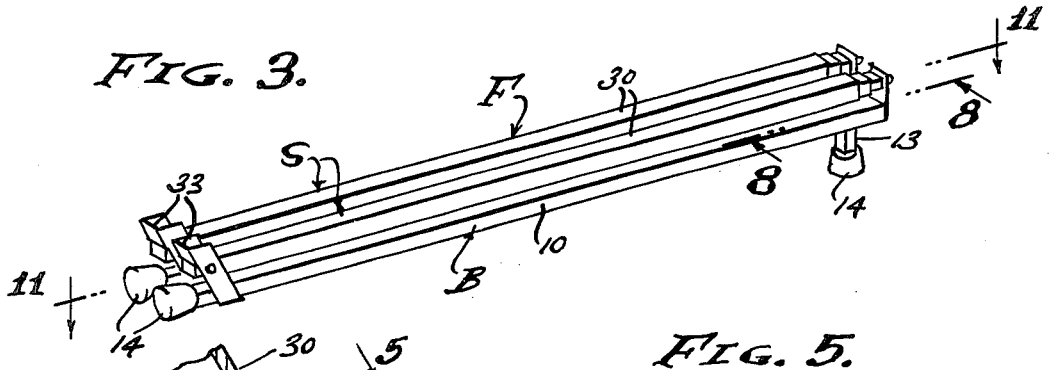
FIG. 5.
FIG. 4.
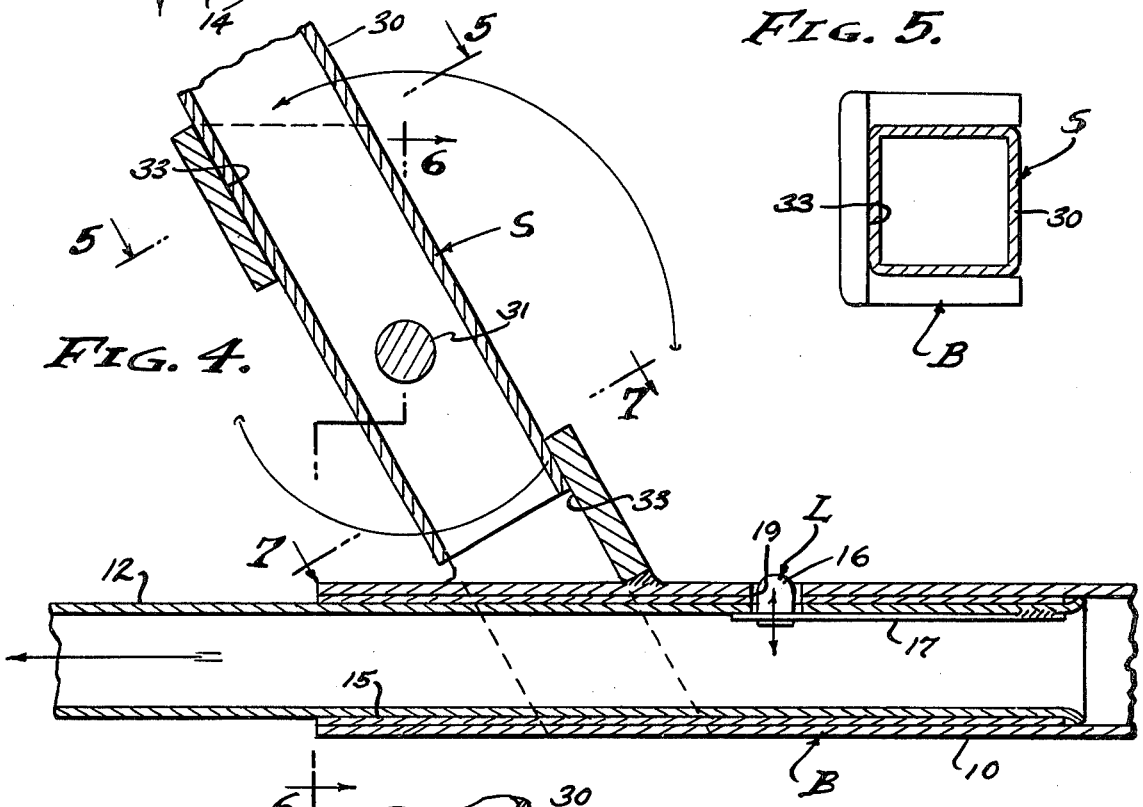
FIG. 6.
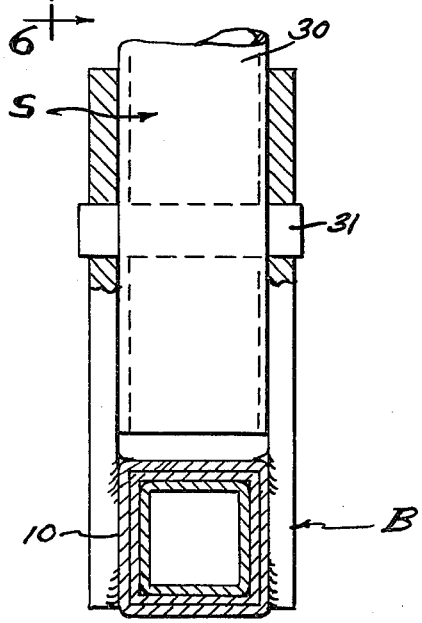
FIG. 7.
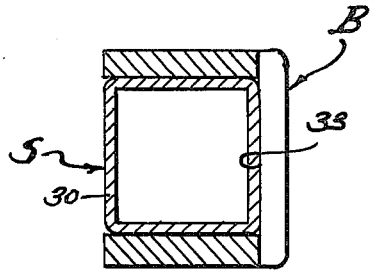

FIG. 8.
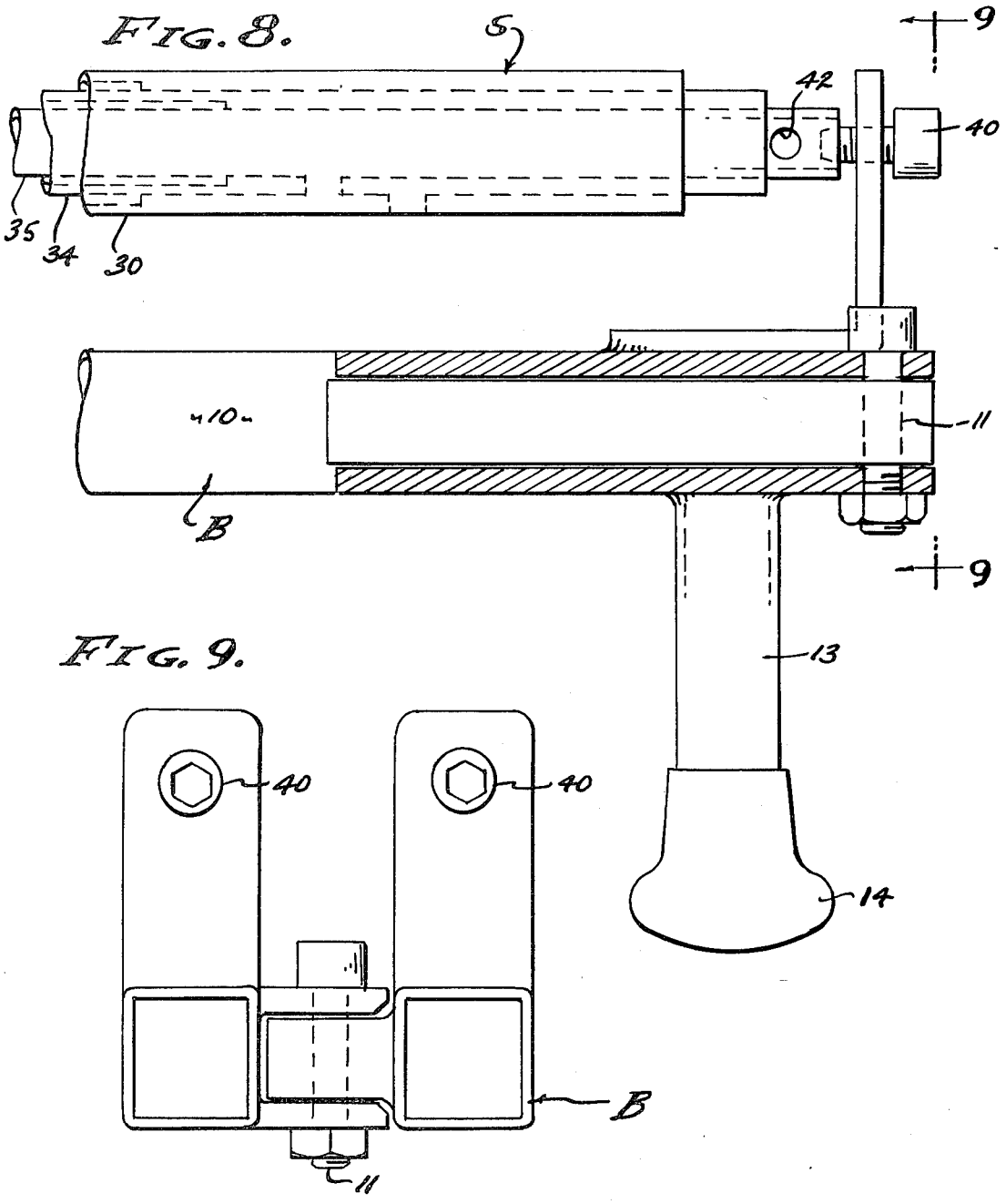
FIG. 9.
FIG. 10.
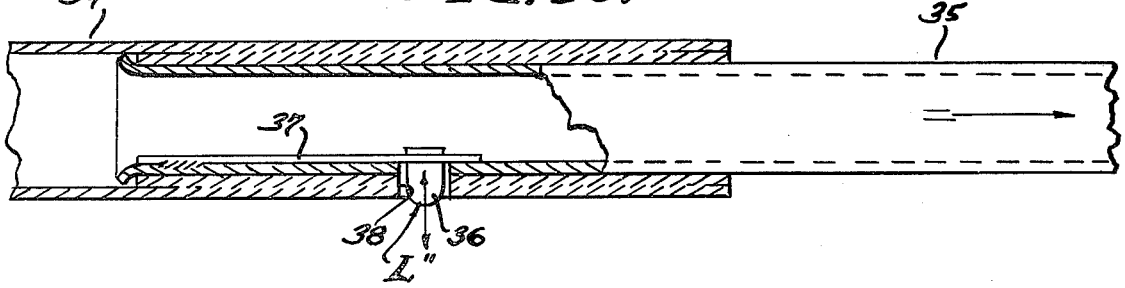

FIG. 11.
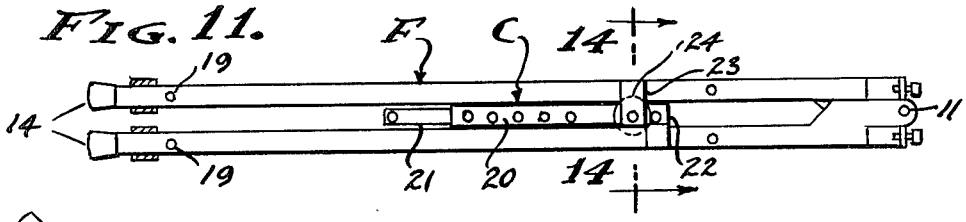
FIG. 12.
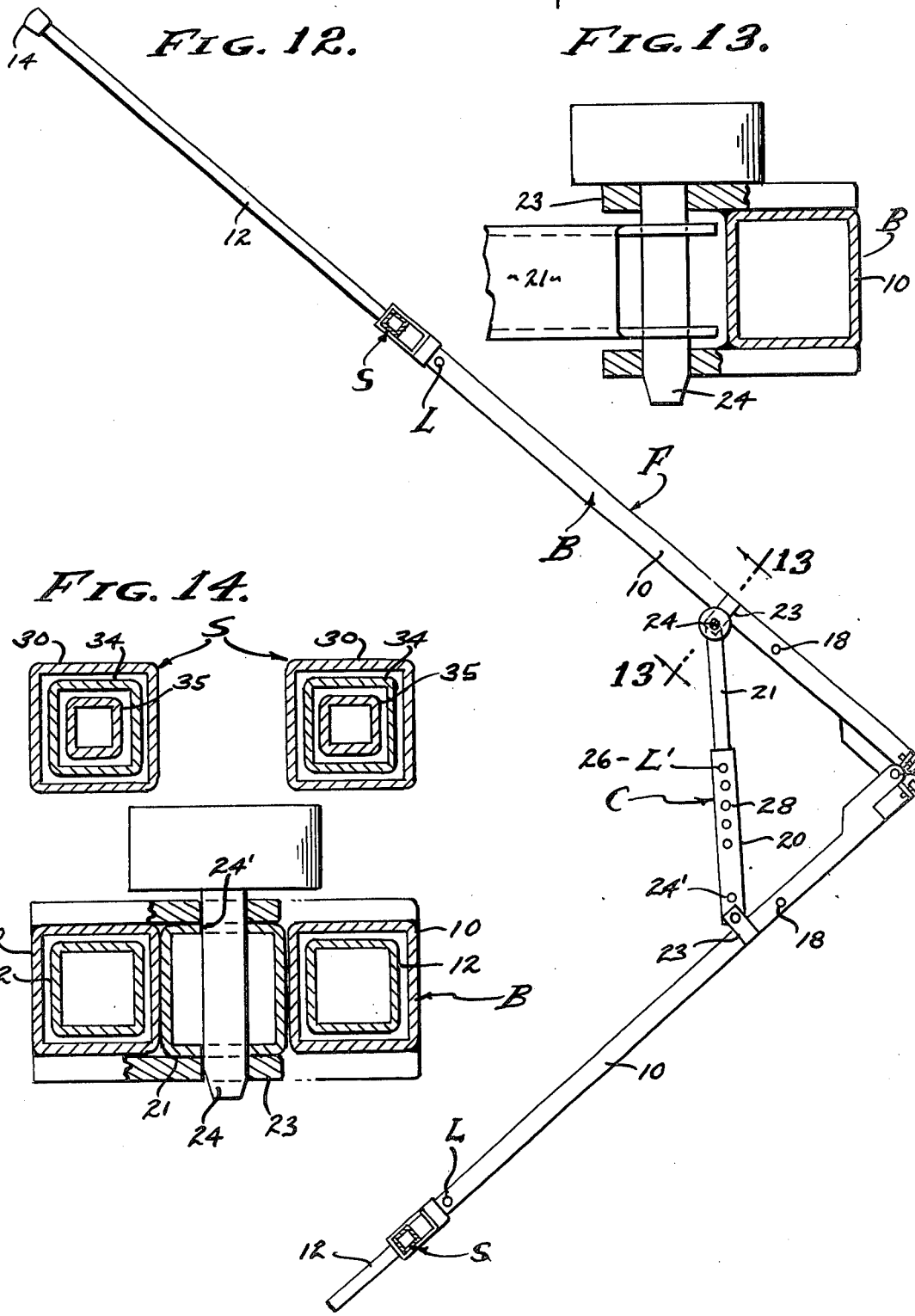
FIG. 13.
FIG. 14.

COLLAPSIBLE FRAME WITH HANGING NET BALL ARRESTING APPARATUS

BACKGROUND

Various sports require the use of balls and backstops therefor, such as nets placed behind the catcher in baseball, or practice nets into which balls are directed or thrown. For example, the game of tennis is practiced by serving and/or returning served balls into a net that damps the trajectory of and arrests the balls so that retrieval is not a problem. And, ball nets of this description must be rather extensive in order to be practical, and all of which necessitates the erection of supporting standards such as poles and frames. The permanency of fixed installations is a great disadvantage, and for this reason portable frames for the support of ball arresting nets have been proposed but which tend to be complicated, ungainly and met with erection and dismantling difficulties. Further, such frames tend to be flimsy with bracing for rigidity rather than utilizing the functions of flexibility to advantage which is an object of this invention.

Height expansion of such frames most often requires the use of auxiliary equipment such as chairs and/or ladders for installing and/or removing the net, it being an object herein to provide a self-sufficient ball net frame. Portability is a primary object of this invention, to provide ball net frame that can be carried within a minimum of space and erected and/or collapsed without the use of any auxiliary equipment. Further, it is an object to provide for augmentation of the frame size as circumstances require to accommodate nets of different size. With this invention, there are telescoped tubular members which fold together into a compact bundle when collapsed, with parts and members remaining interconnected and available for extension without any rearrangement thereof. Augmentation of the frame is determined by the height and width requirements of the net to be suspended thereby, and the weight and balance of the erected members inherently suspends a net for the absorption of energy in arresting a ball impacting into the net, whether the impact point be at the margin thereof or centered therein.

The simple and rugged character of this frame is an object wherein mass and placement of the center of gravity is a factor that operates in conjunction with flexibility and collapsibility as well, to absorb ball energy without damage to the structure. With the present invention, the impact forces of a ball impinging into the net causes frame movements in a direction of collapse thereof, but without adverse affect while remaining erected in ground engaged equilibrium. That is, the frame is massive with a center of gravity that makes it stable, not only to support the static weight of the net but also to remain stable against the dynamic forces applied in arresting the motion of a ball. In practice, the ball net tends to pull together along its margins upon ball impact, and to this end the frame is flexible so as to permit shortening of the top margin of the net, and as well to permit some rearward swing of the frame members that are flexible as well; the net being held taut between said frame members in readiness for the impact of balls therewith.

It is an object to provide a ball net frame of compact and simple construction, and such a frame that is expansively adjustable. To this end, there are base and standard members that are telescoping with stops for both extended and collapsed conditioning, and with adjustment for both height and width of the nets to be used therewith. In practice, there is an A-frame base wherein each leg carries a standard, the base legs being adjustable in angular displacement to carry the extensible standards that suspend the net. The spread of the base is essentially rigid while support of the standards thereby is resilient, the standard being flexibly resilient as well.

SUMMARY OF INVENTION

This invention relates to a portable frame for the support of nets that arrest balls impinged thereagainst. The ball arresting net drops from the peaks of spaced standards that swing upward into a stopped position resting forwardly by gravity. The standards are telescopically extensible to the substantial height of the net, greater than that reachable by a normal person, and biased one away from the other to tension the upper margin of the net suspended therebetween. The net drapes by gravity from the spaced standard peaks with its lower margin folded onto the supporting ground plane, hung by a pair of hooks in a vertical plane forward of the base legs. The supporting standards rest by gravity against stops on the base legs, to extend upwardly and forwardly and free to swing rearwardly from said stops. A feature is the inner leg sections and inner arm sections of like extent which fold one adjacent the other into compact parallel relationship, and from which outer leg and arm sections are extensible for erection and augmentation of the frame. In practice, the net is hooked to the peaks of the standards before the outer arm sections are extended, and the lateral spacing of the base legs is adjusted by a spreader so as to bias the standards apart with the net stretched therebetween. When collapsed, both the legs and arms are captured in retracted positions where they are positively secured.

DRAWINGS

The various objects and features of this invention will be fully understood from the following detailed description of the typical preferred form and application thereof, throughout which description reference is made to the accompanying drawings, in which:

FIG. 3 is an enlarged perspective view of the ball net frame in its collapsed condition.

FIG. 4 is an enlarged detailed fragmentary view taken as indicated by line 4—4 on FIG. 2.

FIGS. 5, 6, and 7 are detailed sectional views taken as indicated by lines 5—5, 6—6, and 7—7 on FIG. 4.

FIG. 8 is an enlarged detailed fragmentary view taken as indicated by line 8—8 on FIG. 3.

FIG. 9 is a detailed end view taken as indicated by line 9—9 on FIG. 8.

Figure 1:
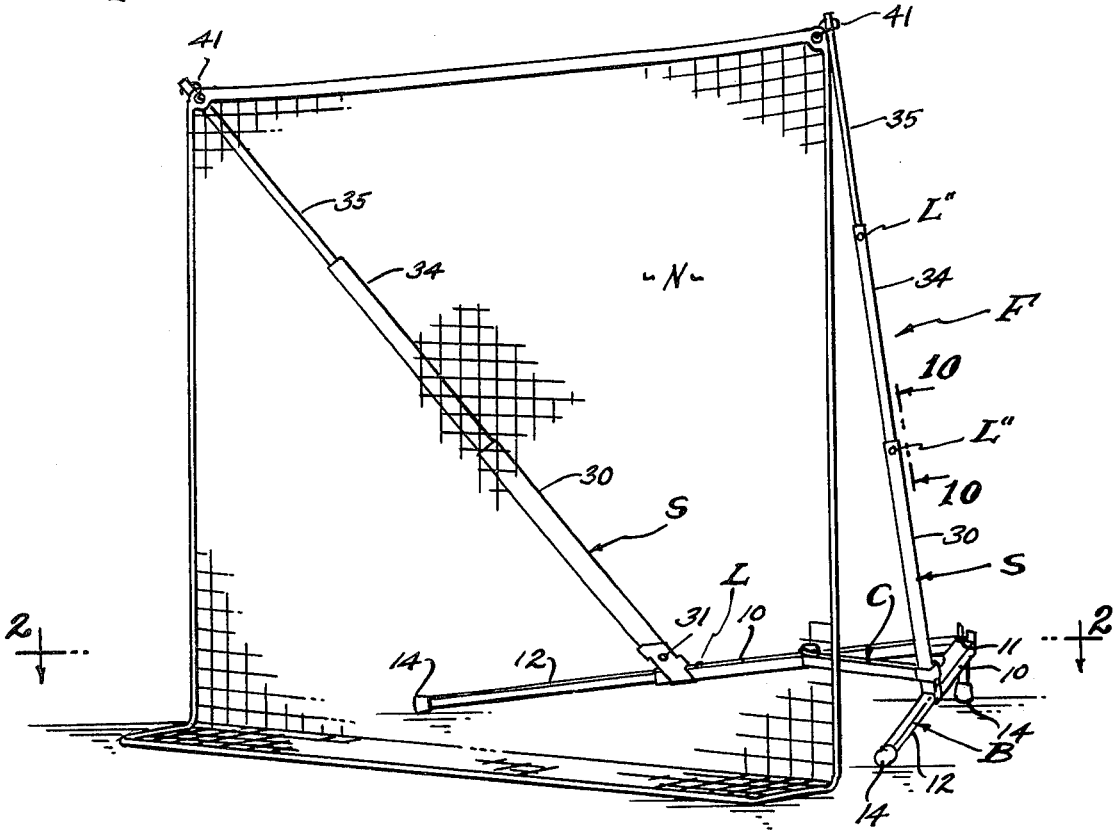
FIG. 1 is a front perspective view of the collapsible and adjustable ball net frame of the present invention.

FIG. 10 is a detailed sectional view taken as indicated by line 10—10 on FIG. 1.

FIG. 11 is a plan section taken as indicated by line 11—11 on FIG. 3.

Figure 2:
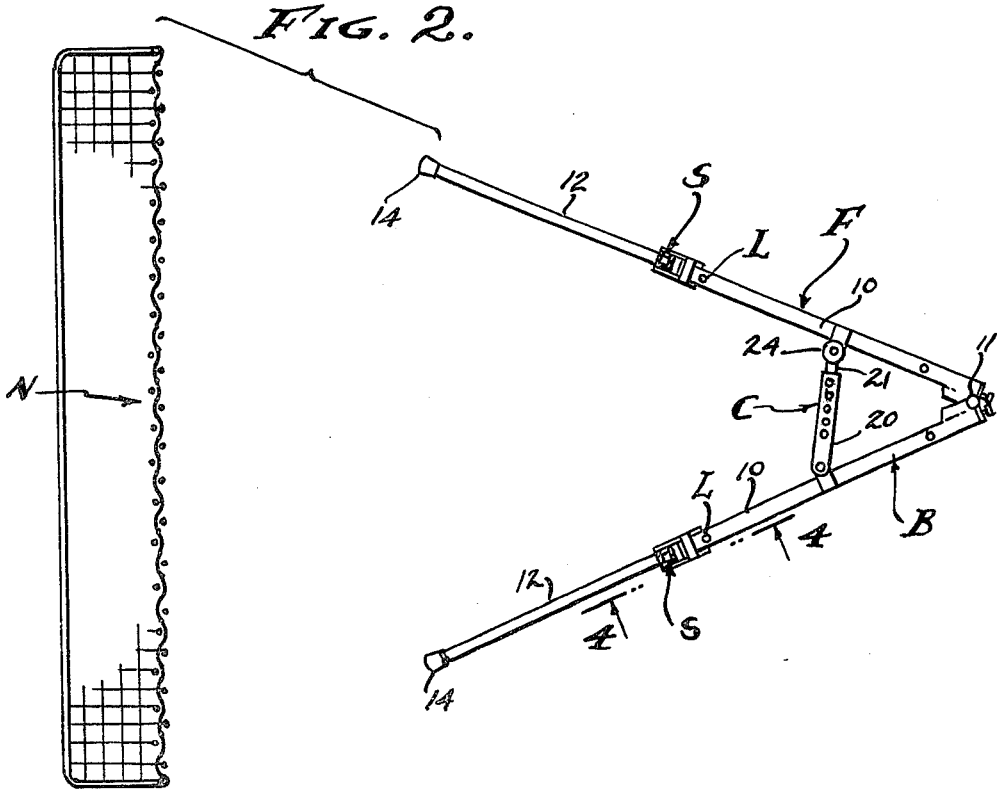
FIG. 2 is a plan section taken as indicated by line 2—2 on FIG. 1.

FIG. 12 is an enlarged plan section, similar to FIG. 2, showing the base in its expanded condition.

FIG. 13 is an enlarged detailed sectional view taken as indicated by line 13—13 on FIG. 12, and FIG. 14 is an enlarged detailed sectional view taken as indicated by line 14—14 on FIG. 11.

PREFERRED EMBODIMENT

Referring now to the drawings, the frame F is erected to hang a net N in a transverse vertically disposed frontal plane adapted to intercept balls directed to impinge thereagainst, as illustrated in FIG. 1. Alternately, the frame is collapsed into a compact condition conducive to portability and storage, with the net removed as shown in FIG. 3. All frame parts are included in either condition, to comprise a base B and a pair of standards S, all of which are functionally established by unfolding the frame and by extending the legs and arms as will be described. A feature is the uniform length of the inner legs and the inner arms of substantial length and into which outer legs and arms telescope for retraction and extension as circumstances require. Generally, the base B in its functional plan configuration is an A-frame, while the standards S are divergent poles terminating in peaks cantilevered over the foremost extent of the outer forwardly extended legs.

The frame base B and standards S are comprised of slideably fitted tubes that telescope one within the other. In practice, square tubes of steel are employed for their strength and mass, and which are commercially available in nominal sizes to slideably fit into telescopic relationship. Such tubes have the desirable deflection properties adapted to this frame F.

The base B is adapted to unfold from its collapsed and telescopically retracted condition, to an open and telescopically extended condition disposed in plan configuration as an A-frame (compare FIGS. 2 and 11). The base B is comprised of a pair of inner leg sections 10 joined by a hinge 11 at their rear ends, and with outer leg sections 12 telescopically extensible from their front ends respectively. The hinge 11 as shown in FIGS. 8 and 9 is disposed on a vertical axis intermediate the leg sections 10 which are spaced thereby a distance substantially equal to their cross sectional dimension, and all to the end that said legs lie parallel one with the other when in the collapsed position (see FIG. 11). As shown, the apex of the frame is supported above the ground plane, and to this end a post 13 with a crutch-tip 14 depends from the hinge 11 to elevate the same a short distance.

The outer leg sections 12 are retractably extensible from the inner leg sections 10, so as to substantially double the length of each leg, and with a crutch-tip 14 at the terminal end of each for ground support. As shown, there is a guide sleeve 15 at the foremost end of each arm section 10 and between the telescopically engaged tubes, and the innermost end of the leg section 12 is flared so as to slide with some clearance within the surrounding leg section 10. As best illustrated in FIG. 4 there is a latch L in the form of a depressible detent bottom 16 carried by a leaf spring 17, and operating through registerable openings in the two tubes that are positioned thereby. As comparatively illustrated in FIGS. 11 and 12, there is a rearmost opening 18 in leg 10 to be engaged by latch L for retractably positioning the inner leg section 11, and there is a foremost opening 19 in leg section 11 to be engaged by latch L extensibly positioning the inner leg section 11.

In accordance with this invention, the leg sections 10 and the retractably extensible leg sections 12 are positioned in angularly divergent relationship to form said A-frame configuration by an adjustable strut means C that determines a fixed angular displacement of said legs. As comparatively illustrated in FIGS. 2 and 12, the legs of frame B are adapted to be secured in various angularly divergent positions, for example more acute in FIG. 2 than in FIG. 12. Accordingly, the strut means C involves retractably extensible tube members 20 and 21 operable between a clevis 22 and a clevis 23 at the opposite inside of each leg section 10. As shown in FIG. 11, the clevises 22 and 23 occupy the space between legs when the frame is collapsed, and they are radially offset from the hinge 11 to overlap. The clevis 22 is permanently interconnected to a tubular strut member 20 while the clevis 23 is a releasable connection established by a removable pin 24 (see FIG. 13), whereby the strut means can unfold from the position shown in FIG. 11 to that shown in FIGS. 1, 2, and 12. A feature is the replacement of pin 24 to secure the angularity of the frame legs and the folded or collapsed condition as well (see FIGS. 11 and 14). Accordingly, lock openings 24' are positioned in tube member 20 to register with clevis 23, in order to receive pin 24 therethrough when the tube member 20 or strut lies adjacent the legs 10 respectively. Adjustment of the strut means C is by means of a latch L' in the form of a depressible detent button 26 carried by a leaf spring (not shown and the same as in FIGS. 10 and 14), and operable through registerable openings in the two tube members 20 and 21 that are positioned thereby. The latch L' is carried by the inner tube member 21 with the button 26 operable through any one of a plurality of adjustment openings 28. It will be seen that the angular displacement of the base legs is fixedly established by the strut means C.

As best illustrated in FIG. 1 of the drawings, the base B is provided to support a pair of divergent retractably extensible standards S. The standards S are alike and each is comprised of telescopically related tubes and one slideable into the other, and the inner tube pivotally coupled to the foremost end of leg section 10 to swing relative thereto. A feature of the invention is the free swinging standards S that extend upwardly and divergently from the base so as to tension the net between the peaks thereof. To these ends each standard S is comprised of an inner arm section 30 permanently pivoted to the end of the leg section 10 by a pivot pin 31 disposed on a transverse longitudinal axis above the said leg, and so that the arm will lie spaced and parallel from the leg a distance substantially equal to the cross sectional dimension of the leg, as best illustrated in FIG. 14. As shown in FIG. 1, the arm section 30 leans forwardly by means of gravity to bear into positioned engagement with stops 33, for example at an angle of sixty degrees relative to the base. The arm section 30 is substantially the same length as the leg section 10 and is adapted to cantilever forwardly therefrom to overlie the extended outer leg section 12, remaining free to swing rearward.

There is at least inner and outer arm sections 30 and 35 to comprise the standard S, and preferably an intermediate arm section 34 also, whereby the peak of the outermost arm section can be raised to a substantial height. The arm tubes are telescopically related with bearing sleeves at the outer end of one tube to slideably receive the inner flared end of the next innermost tube. One tube is adjustably positioned to another by a latch L'' as shown in FIGS. 1 and 10, in the form of a depressible detent button 36 carried by a leaf spring 37 secured to the inner tube and the button projecting through an opening therein and into a positioning opening in the outer tube to be positioned thereby. As shown, there is a positioning opening 38 for each moveable arm section 34 and 35 (see FIG. 10) and into which separate latches L" are engageable. The arm sections 30, 34 and 35 are stopped in the retracted position with their end portions exposed (see FIG. 8), in which conditioning the open end of each outermost arm is intercepted by a retainer 40. As shown, the retainer 40 is a screw pin that positions the telescoped arms as shown in FIG. 14 (also see FIG. 9).

From the foregoing, it will be seen that this portable ball net frame folds into a compact arrangement of closely spaced parallel tube members into which extensible leg and arm sections thereof are telescopically retracted. The telescopically moveable leg and arm sections have inward as well as outward limits of travel, and the extended positions thereof are secured by latch means. The frame F is unfolded from the collapsed condition by withdrawing the retainers 40 from the outermost arm sections and the replaceable pin 24 removed from the lock openings 24', and the strut means C rearranged to secure the end of tube member 21 in the clevis 23 to be secured thereby. The outer leg sections 12 are then extended and the inner arm sections 30 lifted upward to swing beyond center and in order to bear forwardly against the stops 33, whereupon the eyes at the opposite top corners of net N are hung by means of sister hooks 41 or the like to the peak openings 42 (see FIG. 8). Elevation of the net N is then a matter of sequentially extending the arm sections 34 and 35 which diverge with an outward bias to tension the top margin of the net between the two standards S. The impact of balls into the net N will partially collapse the net and thereby shorten the margins thereof, especially the top margin and to which the standards S yield by bending and to which the legs of the base B yield by twisting. Excessive impact may lift the standards from the stops 33 without adverse affect, the net returning by gravity as a drape disposed in said frontal plane ever ready to receive the impacts of balls or the like directed thereagainst.

Having described only a typical preferred form and application of our invention, we do not wish to be limited or restricted to the specific details herein set forth, but wish to reserve to ourselves any modifications or variations that may appear to those skilled in the art:

We claim:

1. A ball arresting apparatus including; a net, a base comprised of a pair of substantibly horizontal forwardly divergent legs having ground engagement at a rearward apex and the forward extremities thereof, a pair of standards, each standard being pivotally coupled to one of said base legs and having one of its ends resting against a stop on one of said base legs and cantilevered upwardly and forwardly from and in divergent alignment with one of said legs and free to swing rearwardly respectively, and there being means hanging said net from spaced peaks of the other end of said standards to drape therefrom by gravity for the interception and arrestment of balls impacting against a yielding frontal plane established thereby.

2. The ball arresting apparatus as set forth in claim 1, wherein the pair of divergent legs are hinged at the apex thereof for angular adjustment, there being strut means extending between and angularly positioning said pair of legs.

3. The ball arresting apparatus as set forth in claim 1, wherein the pair of divergent legs are hinged at the apex thereof for angular adjustment and with a post depending from said apex for ground engagement, there being strut means extending between and angularly positioning said pair of legs, wherein each standard is pivotally coupled to one of said legs to rest forwardly against a stop from which it is free to swing rearwardly, wherein the free distance between the spaced peaks of the pair of standards exceeds the upper marginal extent of the net, said standards yielding inwardly thereby to tension said net, and wherein the net is hung from the spaced peaks of the pair of standards and with its lower margin folded onto the ground plane.

4. A collapsible ball arresting apparatus including; a net, a base comprised of a pair of forwardly divergent and extensible legs having ground engagement at a rearward hinged apex and the forward extremities thereof, there being strut means extending between and angularly positioning said pair of legs, and a pair of extensible standards and each cantilevered upwardly and forwardly from and in divergent alignment with one of said legs respectively, and there being means to hang the net from the spaced peaks of said standards to drape therefrom by gravity for the interception and arrestment of balls impacting against the yielding frontal plane established thereby.

5. The collapsible ball arresting apparatus as set forth in claim 4, wherein the extensible legs are telescoping members and each comprised of an inner leg section from which an outer leg section retractably extends.

6. The collapsible ball arresting apparatus as set forth in claim 4, wherein the extensible legs are telescoping members and each comprised of an inner leg section from which an outer leg section retractably extends, and with latch means securing the extended position of the outer leg section.

7. The collapsible ball arresting apparatus as set forth in claim 4, wherein the extensible legs are telescoping members and each comprised of an inner leg section from which an outer leg section retractably extends, and with latch means alternately securing the retracted and extended positions of the outer leg section.

8. The collapsible ball arresting apparatus as set forth in claim 4, wherein the extensible standards are telescoping members and each comprised of an inner arm section from which an outer arm section retractably extends.

9. The collapsible ball arresting apparatus as set forth in claim 4, wherein the extensible standards are telescoping members and each comprised of an inner arm section from which an outer arm section retractably extends, and with latch means securing the extended position of the outer arm section.

10. The collapsible ball arresting apparatus as set forth in claim 4, wherein the extensible legs are telescoping members and each comprised of an inner leg section from which an outer leg section retractably extends, and wherein the extensible standards are telescoping members and each comprised of an inner arm section from which an outer arm section retractably extends.

11. The collapsible ball arresting apparatus as set forth in claim 4, wherein the extensible legs are telescoping members and each comprised of an inner leg section from which an outer leg section retractably extends and with latch means securing the extended position of the outer leg section, and wherein the extensible standards are telescoping members and each comprised of an inner arm section from which an outer arm section retractably extends and with latch means securing the extended position of the outer arm section.

12. The collapsible ball arresting apparatus as set forth in claim 4, wherein the strut means is adjustably extensible with latch means securing the angular displacement of the base legs.

13. The collapsible ball arresting apparatus as set forth in claim 4, wherein the extensible legs are telescoping members and each comprised of an inner leg section from which an outer leg section retractably extends, and wherein the strut means is adjustably extensible between said inner leg sections and with latch means securing the angular displacement of the said inner base leg section.

14. A folding ball arresting apparatus including: a net a base comprised of a pair of inner leg sections coupled in spaced parallel relation by a reamost hinge when in a folded condition and a pair of outer leg sections extensible from the inner leg sections for ground engagement at a rearward apex of the inner leg sections and at the forward extremities of the outer leg sections when unfolded to be divergent, there being adjustable strut means extending between the folded and unfolded inner leg sections positioning the same, and a pair of extensible standards comprised of a pair of inner arm sections coextensive with said inner leg sections when folded and a pair of outer arm sections extensible from the inner arm sections and cantilevered upwardly and forwardly from the forward end of the inner leg sections and in divergent alignment therewith respectively, and there being means to hang the net from the spaced peaks of the extended outer arm sections to drape therefrom by gravity for the interception and arrestment of balls impacting against the yielding frontal plane established thereby.

15. The folding ball arresting apparatus as set forth in claim 14, wherein retainer means secures the said inner arm sections to the inner leg sections when in the folded condition.

16. The folding ball arresting apparatus as set forth in claim 14 wherein the adjustable strut means pivots to and between clevises that project from and overlap to occupy the space between the inner leg sections when they are folded.

17. The folding ball arresting apparatus as set forth in claim 14, wherein the adjustable strut means is permanently pivoted to one clevis and releasably pivoted to a second clevis that project from the pair of inner leg sections to overlap and occupy the space therebetween when they are folded and in said parallel relation.

18. The folding ball arresting apparatus as set forth in claim 14, wherein retainer means secures the said inner arm sections to the inner leg sections when in the folded condition, and wherein the adjustable strut means pivots to and between clevises that project from and overlap to occupy the space between the inner leg sections when they are folded.

19. The folding ball arresting apparatus as set forth in claim 14, wherein latch means secures the extended position of each outer leg section of the base respectively.

20. The folding ball arresting apparatus as set forth in claim 14, wherein latch means secures the retracted and extended positions of each outer leg section of the base respectively.

21. The folding ball arresting apparatus as set forth in claim 14, wherein latch means secures the extended position of each outer arm section of the standards respectively.

22. The folding ball arresting apparatus as set forth in claim 14, wherein latch means secures the extended position of each outer leg section of the base respectively, and wherein latch means secures the extended position of each outer arm section of the standards respectively.

23. The folding ball arresting apparatus as set forth in claim 14, wherein retainer means secures the said inner arm sections to the inner leg sections when in the folded condition, wherein the adjustable strut means pivots to and between clevises that project from and overlap to occupy the space between the inner leg sections when they are folded, wherein latch means secures the extended position of each outer leg section of the base respectively, and wherein latch means secures the extended position of each outer arm section of the standards respectively.

* * * * *